US009543638B2

(12) United States Patent
Kim

(10) Patent No.: US 9,543,638 B2
(45) Date of Patent: Jan. 10, 2017

(54) FIXING BRACKET FOR ANTENNA CABLE AND PORTABLE TERMINAL HAVING THE SAME

(71) Applicant: LG ELECTRONICS INC., Seoul (KR)

(72) Inventor: Youngil Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 451 days.

(21) Appl. No.: 14/051,252

(22) Filed: Oct. 10, 2013

(65) Prior Publication Data

US 2014/0104118 A1 Apr. 17, 2014

(30) Foreign Application Priority Data

Oct. 12, 2012 (KR) ..... 10-2012-0113727

(51) Int. Cl.
*H01Q 1/24* (2006.01)
*H01Q 1/48* (2006.01)

(52) U.S. Cl.
CPC ..... *H01Q 1/243* (2013.01); *H01Q 1/48* (2013.01)

(58) Field of Classification Search
CPC ..... H01Q 1/242; H01Q 1/38; H01Q 9/0421; H01Q 1/42
USPC ..... 343/702, 872, 878, 889
See application file for complete search history.

(56) References Cited

U.S. PATENT DOCUMENTS 6,899,305 B2 * 5/2005 Korczak ..... F16L 3/12 248/68.1
2006/0038727 A1 * 2/2006 Ikeda ..... H01Q 1/32 343/713

* cited by examiner

*Primary Examiner* — Dameon E Levi
*Assistant Examiner* — Collin Dawkins
(74) *Attorney, Agent, or Firm* — Lee Hong Degerman Kang & Waimey

(57) ABSTRACT

Provided is a portable terminal. The portable terminal includes a metal frame including a cable accommodation part; an antenna cable accommodated into the cable accommodation part, the antenna cable including a conductive part; and a bracket clamping the antenna cable, the bracket being inserted into and coupled to the cable accommodation part. The bracket is formed of a conductive material and in contact with the conductive part.

5 Claims, 5 Drawing Sheets

FIXING BRACKET FOR ANTENNA CABLE AND PORTABLE TERMINAL HAVING THE SAME

CROSS-REFERENCE TO RELATED APPLICATIONS

Pursuant to 35 U.S.C. §119(a), this application claims the benefit of earlier filing date and right of priority to Korean Patent Application No. 10-2012-0113727, filed on Oct. 12, 2012, the contents of which are hereby incorporated by reference herein in their entirety.

BACKGROUND

The present disclosure relates to a fixing bracket for an antenna cable and a portable terminal having the same, and more particularly, to a portable terminal which includes a conductive bracket clamping an antenna cable to improve grounding effects and assemblability.

Portable terminals represent devices that are portable by a user to perform wireless communication. Such a portable terminal includes an antenna.

The antenna is connected to a main board within the portable terminal to transmit a signal. Also, the antenna is fixed to a metal frame.

The metal frame provided within the portable terminal may be accurately molded by die casting. Thus, since the metal frame is not elastically deformed, relatively high accuracy is required when assembled.

Also, when a portion of the antenna cable is fixed to the metal frame, possibility in the occurrence of defects due to location deviation and product deviation is high.

Particularly, the portable terminal should be grounded to reduce signal noises. Here, when a separate member, e.g., a gasket tape is coupled to the outside of the antenna cable to ground the portable terminal, possibility in the occurrence of defects may be further increased. Thus, it may be difficult to ground the portable terminal.

SUMMARY

Embodiments provide a portable terminal including a bracket that is capable of improving assemblability and grounding effects.

In one embodiment, a portable terminal includes: a metal frame including a cable accommodation part; an antenna cable accommodated into the cable accommodation part, the antenna cable including a conductive part; and a bracket clamping the antenna cable, the bracket being inserted into and coupled to the cable accommodation part, wherein the bracket is formed of a conductive material and in contact with the conductive part.

In another embodiment, a fixing bracket for clamping an antenna cable to fix the antenna cable to a metal frame of a portable terminal includes: a clamping part clamping the antenna cable; and a fixing part fixing the clamping part to the metal frame, wherein the fixing bracket is formed of a conductive material.

In further another embodiment, a portable terminal includes: a metal frame including a battery mounting part and a cable accommodation part; an antenna cable accommodated into the cable accommodation part, the antenna cable including a conductive part; and a bracket clamping the antenna cable, the bracket being inserted into and coupled to the cable accommodation part, wherein the bracket is formed of a conductive material and in contact with the conductive part, wherein the bracket includes: a clamping part clamping the antenna cable; and a fixing part fixing the clamping part to the cable accommodation part.

The details of one or more embodiments are set forth in the accompanying drawings and the description below. Other features will be apparent from the description and drawings, and from the claims.

DETAILED DESCRIPTION OF THE EMBODIMENTS

Hereinafter, a fixing bracket for an antenna cable and a portable terminal including the same according to an embodiment will be described in detail with reference to the accompanying drawings.

Figure 1:
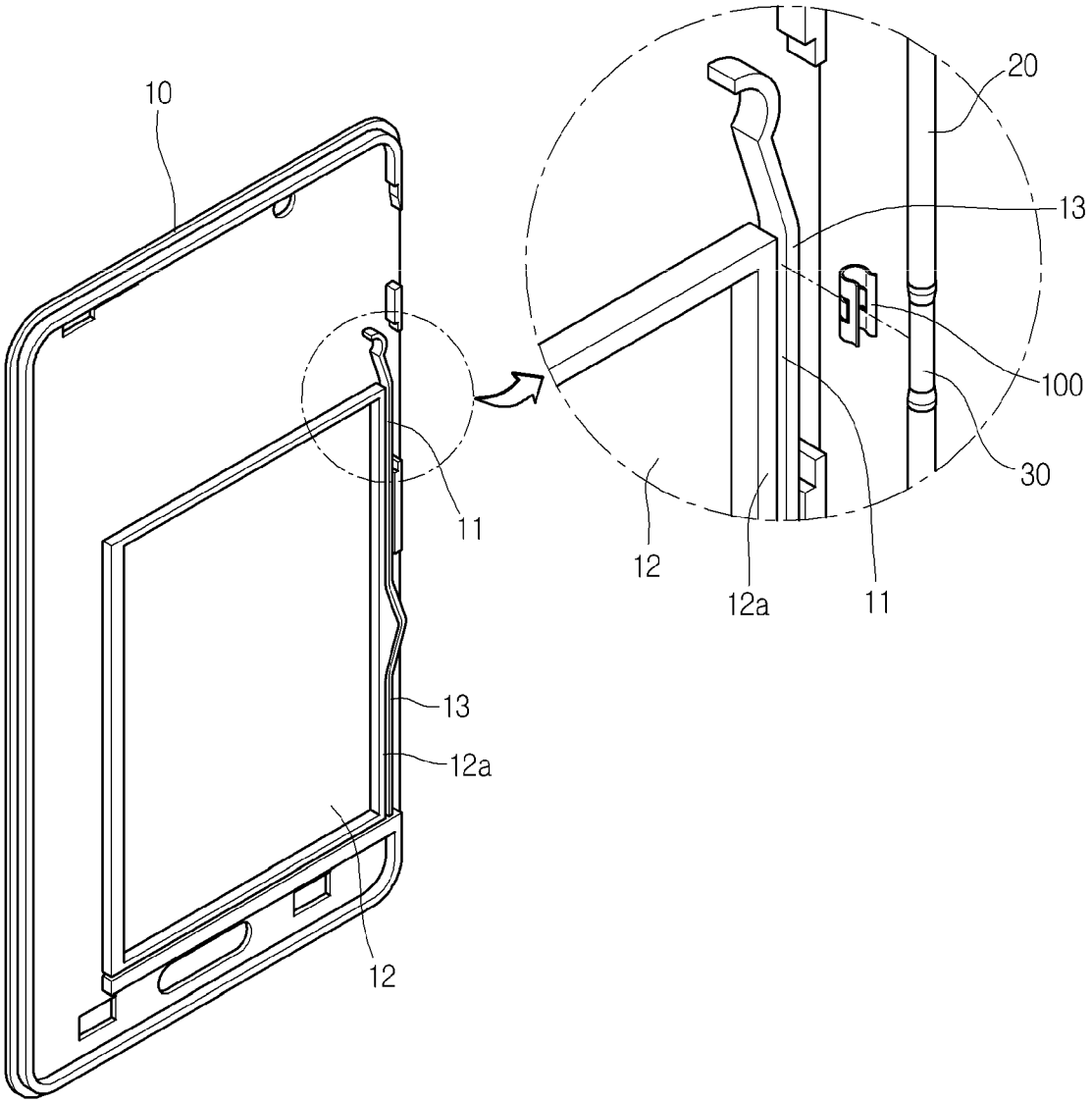
FIG. 1 is a schematic view illustrating a metal frame of a portable terminal according to an embodiment.
Figure 2:
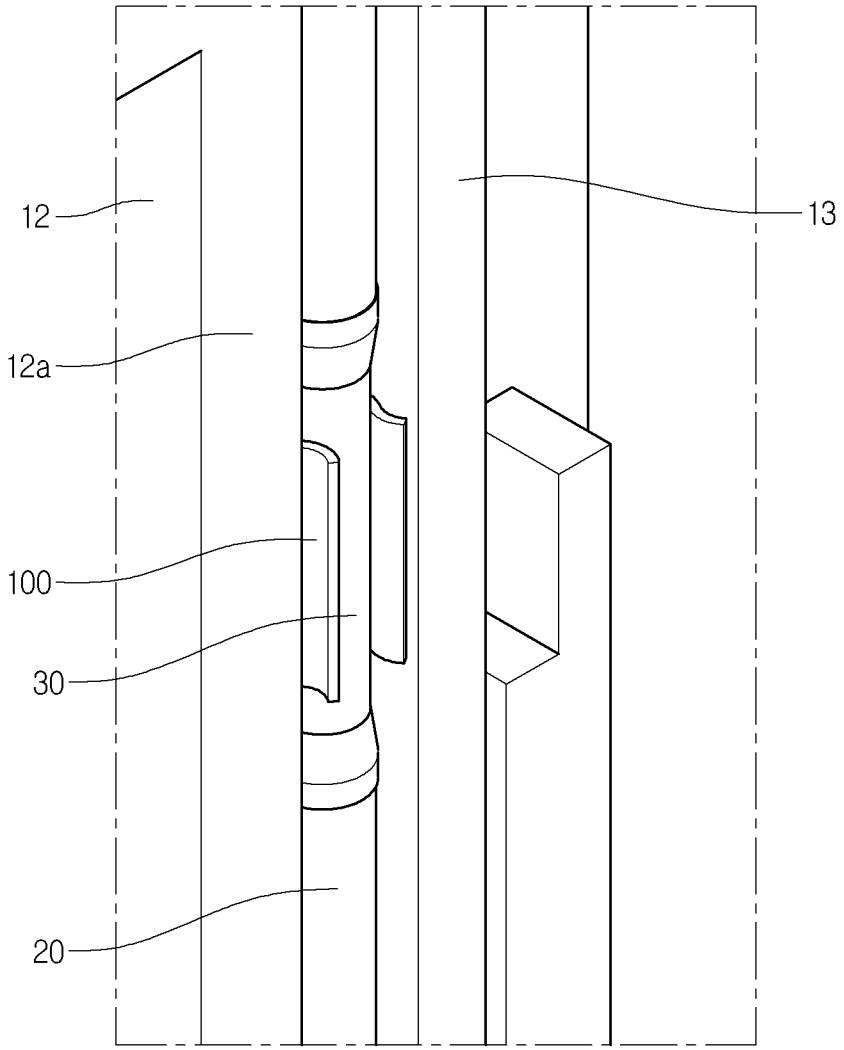
FIG. 2 is a schematic view illustrating a portion of a structure in which an antenna cable is coupled to a metal frame of FIG. 1.

As shown in FIGS. 1 and 2, a portable terminal according to an embodiment includes a metal frame 10, an antenna cable 20 coupled to the metal frame 10, and a bracket 100 clamping the antenna cable 20 to fix the antenna cable 20 to the metal frame 10.

FIG. 1 is a schematic view illustrating the metal frame 10 of the portable terminal according to an embodiment. In a partially enlarged portion in FIG. 1, the antenna cable 20 and the bracket 100 are illustrated. Here, it is seen that the bracket 100 and the antenna cable 20 may be coupled to a cable accommodation part 11 of the metal frame 10. Also, FIG. 2 illustrates a state in which the antenna cable 20 is accommodated into the cable accommodation part through the bracket 100.

In detail, the metal frame 10 may be a portion to which various components of the portable terminal are coupled. The metal frame 10 may be formed of a metal material. For example, a metal such as magnesium or aluminum may be die-casted to mold an accurate metal frame.

The cable accommodation part 11, a battery mounting part 12, and a fixing partition wall 13 are disposed on the metal frame 10. Hereinafter, detailed configurations of the battery mounting part 12, the fixing partition wall 13, and the cable accommodation part 11 are successively descried in detail.

The battery mounting part 12 is disposed on an approximately central portion of the metal frame 10. The battery mounting part 12 includes a battery mounting partition wall 12*a* partitioning an inner space. The battery mounting partition wall 12*a* protrudes outward from one surface of the frame 10. Also, four battery mounting partition walls 12*a* define an approximately rectangular plane shape. A battery (not shown) for supplying a power to the portable terminal is coupled to the battery mounting part 12.

The fixing partition wall 13 is disposed outside the battery mounting part 12. The fixing partition wall 13 protrudes from one surface (see a top surface in FIGS. 3 to 6) of the metal frame 10 in the same direction (see an upward direction) as that of the battery mounting partition wall 12*a*. The fixing partition wall 13 may extend approximately parallel to one of the battery mounting partition walls 12*a*.

The cable accommodation part 11 is disposed outside the battery mounting part 12. In more detail, the cable accommodation part 11 may be disposed between the battery mounting partition walls 12*a* and the fixing wall 13. In this case, one side of the cable accommodation part 11 may be partitioned by the battery mounting partition walls 12*a*, and the other side of the cable accommodation part 11 may be partitioned by the fixing partition wall 13. Thus, the cable accommodation part 11 may be defined as a space between the battery mounting partition walls 12*a* and the fixing wall 13. Thus, the cable accommodation part 11 may be disposed parallel to one battery mounting partition wall 12*a*.

An antenna cable 20 that will be described later is coupled to the cable accommodation part 11.

Figure 4:
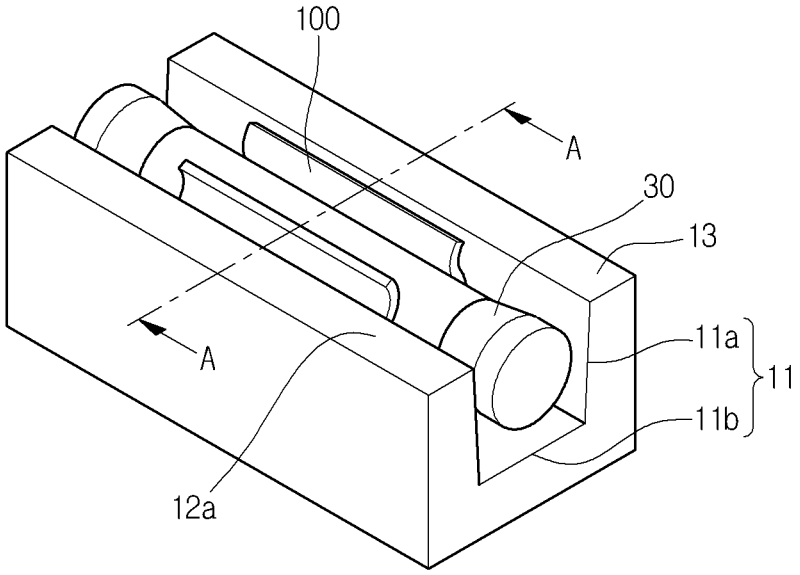
FIG. 4 is a view illustrating a state in which portions of a cable accommodation part and the antenna cable coupled to the cable accommodation part are blocked in the portable terminal according to an embodiment.
Figure 5:
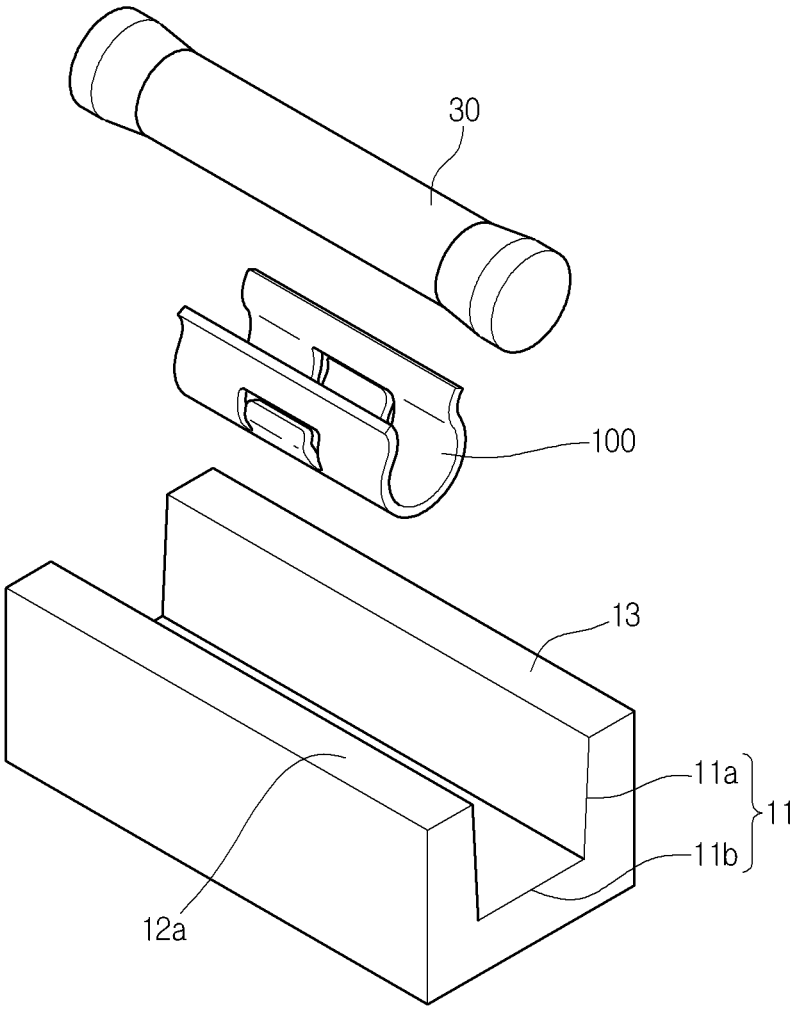
FIG. 5 is an exploded perspective view of FIG. 4.

Referring to FIGS. 4 and 5, explaining the cable accommodation part 11 in detail, the cable accommodation part 11 has a bottom surface 11*b* and two side surfaces 11*a* protruding upward from the bottom surface 11*b*. Here, the bottom surface 11*b* may be understood as one surface of the metal frame 10. Also, one of the two side surfaces 11*a* may be understood as an outer surface of one battery mounting partition wall 12*a*. Also, the other one of the two side surfaces 11*a* may be understood as one surface of the fixing partition wall 13 facing the corresponding battery mounting partition wall 12*a*.

The battery accommodation part 11, as shown in FIG. 1, may extend from an edge of the metal frame 10 along a longitudinal direction. However, the present disclosure is not limited thereto. For example, the battery accommodation part 11 may be variously selected in shape according to the positions of an antenna and a main board and an arrangement relation between other components.

The antenna cable 20 is accommodated into the cable accommodation part 11 in a state where the antenna cable 20 is coupled to a bracket 100 that will be described later.

The cable may be configured to transmit a signal between the antenna (not shown) and the main board (not shown). Also, a sheath of the cable 20 may be cut at a predetermined position thereof. Here, a conductive part 30 having an approximately cylindrical shape and formed of a conductive material is provided at the portion at which the sheath is cut.

Thus, in the cable 20, current may flow through a portion surrounded by the sheath. However, current may not flow through both ends of the cable 20 connected to the antenna and the main board and the portion on which the conductive part 30 is disposed. The bracket 00 is coupled to the outside of the conductive part 30.

A detailed configuration of the bracket 100 will be described in detail with reference to FIG. 3.

The bracket 100 includes a clamping part 110 surrounding the conductive part 30 and a fixing part 120 fixing the clamping part 110 to the cable accommodation part 11.

The clamping part 110 includes a body 111, of which a portion of an upper portion is opened, having a cylindrical shape and a guard part inclinedly extending outward from an upper end of the body 111 in an upward and width direction.

An opening cut in a longitudinal direction of the body 111 is defined in the upper portion of the body 111. A rounded one surface of the body 111 laying cylindrical shape is opened to define the opening 113. If an external force is not applied, the opening 113 may have a length in a width direction less than that of the conductive part 30 in a width direction.

However, the conductive part 30 of the cable may be inserted into the clamping part 110 through the opening 113 or separated outward from the clamping part 110. The clamping part 110 may be elastically deformable in the width direction and then extended or contracted. Thus, in this case, the opening 113 may be changed in width.

FIG. 4 illustrates a state in which the conductive part 30 and the antenna cable 20 are inserted into the clamping part 110 of the bracket 100. FIG. 5 illustrates a state in which the conductive part 30 and the antenna cable 20 are not inserted into the bracket 100.

Here, the antenna cable 20 illustrated in FIGS. 4 and 5 may be simplified for convenience of description in the current embodiment. That is, a detailed inner structure of the antenna cable 20 including a conductor or a core is omitted.

The guide part 112 is disposed on an upper end of the body 111 having the opening 113 to guide the insertion of the conductive part 30. As described above, the guide part 112 may extend upward and outward from the opening 113. Here, the guide part 112 may have a curved surface that is bent outward.

Also, a connection portion between the body 111 and the guide part 112 may be rounded.

The guide part 112 extends from both ends of the opening in the longitudinal direction of the opening 113 and the body 111.

Figure 6:
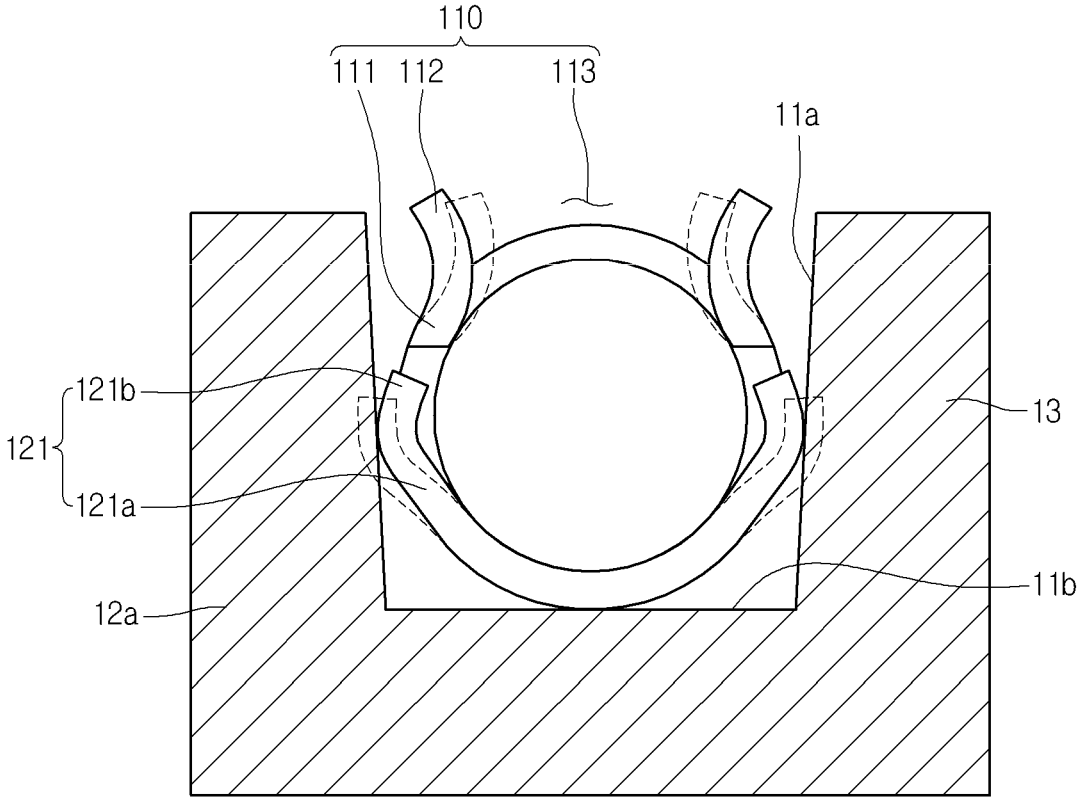
FIG. 6 is a cross-sectional view taken along line A-A of FIG. 4.

Thus, as shown in FIG. 6, the clamping part 110 may have a sectional shape which is expanded outward and then contracted inward while the clamping part 110 extends upward from a lower end along the trace of a circle, and then, extends outward in a curved shape from a time point at which the opening 113 is formed.

The body 111 and the guide part 112 may be integrated with each other.

The fixing part 120 includes an elastically deformable protrusion 121 protruding outward from the clamping part 110 and a cutoff part 122 extending along a portion of an edge of the protrusion 121. The protrusion 121 may be provided in a pair in the width direction.

In the configuration of the protrusion 121, the protrusion 121 includes a first extension part 121*a* inclinedly extending upward from the clamping part 110 and a second extension part 121*b* bent inward from an end of the first extension part 121*a* at a predetermined angle to extend.

Each of the first and second extension parts 121*a* and 121*b* may have a rounded surface. That is, the second extension part 121*b* may have a shape bent upward and inward from the end of the first extension part 121*a*.

Figure 3:
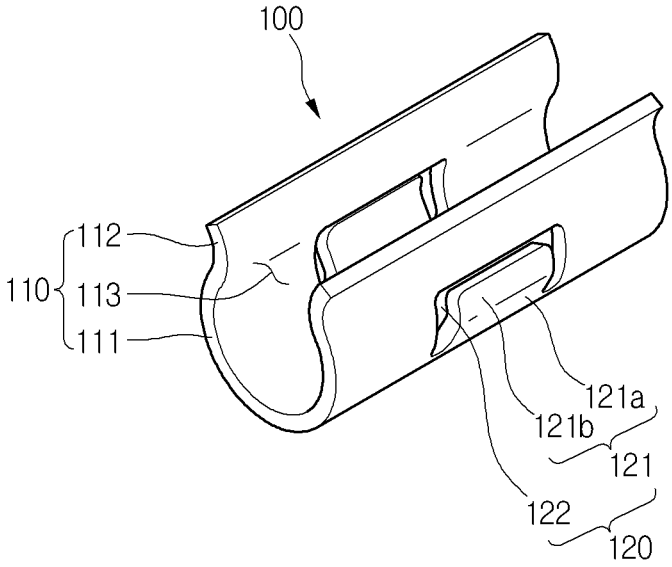
FIG. 3 is a schematic view of a bracket of a portable terminal according to an embodiment.

Thus, as shown in a dotted line in FIGS. 3, 5, and 6, before the bracket 100 is inserted into the cable accommodation part 11, the protrusion 121 may further protrude outward from the clamping part 110. That is, when an external force is not applied, the pair of protrusions 121 may have a length in the width direction greater than between the pair of side surfaces 11*a*. However, when the bracket 100 is pressed toward the cable accommodation part 11, the first extension part 121*a* of the protrusion 121 may be pressed inward by the side surface 11*a* of the cable accommodation part 11 and thus be elastically deformed. Thus, the bracket 100 may be inserted into the cable accommodation part 11.

In this process, the protrusion 121 presses the side surface of the cable accommodation part 11 by an elastic force that returns to its original position in the bracket 100 inserted into the cable accommodation part 11. Thus, the bracket 100 may be firmly fixed to the inside of the cable accommodation part 11 without using a separate adhesive.

The clamping part 110 and the fixing part 120 may be integrated with each other to constitute the bracket 100. Thus, the bracket 100 may be formed of a conductive metallic material having elasticity.

Therefore, since the conductive part 30, the bracket 100, and the metal frame 10 are maintained in the firmly contact state, a grounding effect may be improved.

The above-described bracket 100 may be provided in at least one. The number of brackets 100 may be adequately selected as necessary according to the installed position and number of bracket 100 within the metal frame.

That is, the bracket 100 may be provided in plurality. When the bracket 100 is provided in plurality, the conductive part 30 of the cable 20 may also be provided in plurality to correspond to the number of brackets 100. In this case, if it is difficult to achieve the ground effect by one bracket 100, the ground effect may be achieved by the other bracket 100 and the conductive part 30.

Hereinafter, a process of assembling the antenna cable 20 by using the bracket 100 having the above-described structure will be described.

First, the bracket 100 is inserted into and then coupled to the conductive part 30 of the antenna cable 20.

In this process, since the conductive part 30 has a diameter greater than a width of the opening 113, when the conductive part 30 is inserted into the body 111 of the bracket 100 through the opening 113, the guide part 112 may be pressed to further extend the opening 113. Thus, the conductive part 30 may be inserted into the body 111 through the further extended opening 113.

Since the guide part 112 is provided, even though the conductive part 30 is not disposed at an accurately right center of the opening 113, if the conductive part 30 is pressed, the conductive part 30 may be slid along the guide 112. Thus, since the conductive part 30 is inserted through the opening 113, the assembling process may be easy.

After the cable 20 is inserted into the bracket 100, the bracket 100 is inserted into the cable accommodation part 11 of the metal frame 10.

A distance between the two protrusions 121 protruding from both side surfaces of the bracket 100 may be greater than that between both side surfaces 11*a* of the cable accommodation part 11. Thus, when the bracket 100 is pressed toward the bottom surface 11*b* of the cable accommodation part 11, the protrusion 121 disposed at the dotted point of FIG. 6 is contracted to a position of the solid line of FIG. 6. As a result, the bracket 100 is seated into the cable accommodation part 11.

Here, since the protrusion 121 presses both side surface 11*a* of the cable accommodation part 11 by the elastically restoring force that returns to its original shape as shown in the dotted line of FIG. 6, the bracket 100 may be firmly fixed to the inside of the cable accommodation part 11.

Also, since the conductive part 30, the bracket 100, and the metal frame 10 are conductively connected to each other by the above-described coupling, the grounding effect may be improved to reduce noises generated when the signal is transmitted.

Also, since the cutoff part 122 is disposed in the edge of the protrusion 121, the protrusion 121 may be smoothly contracted. If the cutoff part 122 is not provided, when the protrusion 121 is contracted from the position of the dotted line to the position of the solid line in FIG. 6, portions at which the protrusion 121 and the body 111 are in contact with each other may overlap each other. Thus, the inward contraction of the protrusion 121 may be restrained. As a result, the cutoff part 122 may be provided to solve the above-described limitation.

Also, as described above, the bracket 100 may be inserted first into the conductive part 30 of the antenna cable 20, and then the antenna cable 20 may be coupled to the cable accommodation part 11 of the metal frame 10. However, the present disclosure is not limited to the above-described order. For example, the bracket 100 may be coupled first to the cable accommodation part 11, and then the antenna cable 20 may be inserted into and coupled to the bracket 100.

In the portable terminal according to the embodiment, since the antenna cable is coupled to the metal frame by the bracket, the assemblability may be improved, and defect rate due to the assembling deviation and product deviation may be reduced.

Also, since the grounding effect is improved by the bracket, the noises generated in the signal transmission process may be reduced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable terminal comprising:

a metal frame including a cable accommodation part;

an antenna cable positioned in the cable accommodation part, the antenna cable comprising a conductive part; and at least one bracket configured to secure a portion of the antenna cable to the cable accommodation part and to electrically connect the conductive part to the cable accommodation part, wherein the bracket comprises:

a clamping part configured to secure the portion of the antenna cable; and a fixing part configured to be fixed to secure the bracket within the cable accommodation part, wherein the fixing part comprises first and second protrusions that are symmetrical about a width of the body, wherein each of the first and second protrusions is elastically deformable and protrude outward from the clamping part;

wherein the cable accommodation part includes a bottom surface and a pair of side surfaces respectively extending upward from the bottom surface, and a width between the first and second protrusions is greater than a width between the pair of side surfaces of the cable accommodation part when an external force is not applied to the first and second protrusions.

2. The portable terminal according to claim 1, wherein the clamping part comprises:

a body shaped to define an opening along a longitudinal length of the body, wherein the opening is defined at an upper portion of the body; and a guide part extending from an upper end of the body and extending outward from the body.

3. The portable terminal according to claim 2, wherein the clamping part is elastically deformable along a width of the clamping part, the conductive part of the antenna cable is coupled to the clamping part, and the opening has a length in the width direction that is less than a width direction of the conductive part of the antenna cable when an external force is not applied to the clamping part.

4. The portable terminal according to claim 3, wherein the fixing part is shaped to define a cutout along a portion of an edge of the protrusion.

5. The portable terminal according to claim 1, wherein the bracket includes conductive material.

* * * * *